US005872334A

United States Patent [19]

Trazyik

[11] Patent Number: 5,872,334

[45] Date of Patent: Feb. 16, 1999

[54] HIGH-SPEED CABLE

[75] Inventor: William J. Trazyik, Hyde Park, N.Y.

[73] Assignee: International Business Machines Corporation, Armonk, N.Y.

[21] Appl. No.: 818,046

[22] Filed: Mar. 14, 1997

[51] Int. Cl.[6] ..... H01B 11/06

[52] U.S. Cl. ..... 174/36; 174/107; 174/108; 174/117 F

[58] Field of Search ..... 174/36, 117 F, 174/102 SC, 105 SC, 106 SC, 107, 108

[56] References Cited

U.S. PATENT DOCUMENTS

| | | | |
|---|---|---|---|
| 2,586,345 | 2/1952 | King | 174/107 X |
| 3,328,514 | 6/1967 | Cogelia | 174/107 X |
| 3,576,387 | 4/1971 | Derby | 174/36 |
| 4,096,346 | 6/1978 | Stine et al. | 174/36 |
| 4,588,852 | 5/1986 | Fetterolf et al. | 174/36 |
| 4,943,688 | 7/1990 | VanDeusen et al. | 174/36 X |
| 5,037,999 | 8/1991 | VanDeusen | 174/36 |
| 5,107,076 | 4/1992 | Bullock et al. | 174/36 X |
| 5,132,491 | 7/1992 | Mulrooney et al. | 174/36 |
| 5,144,098 | 9/1992 | VanDeusen | 174/36 |
| 5,170,010 | 12/1992 | Aldissi | 174/36 |
| 5,208,426 | 5/1993 | Kennedy et al. | 174/36 |
| 5,256,082 | 10/1993 | Yaegashi et al. | 439/497 |
| 5,283,390 | 2/1994 | Hubis et al. | 174/36 |
| 5,286,923 | 2/1994 | Prudhon et al. | 174/107 X |
| 5,313,017 | 5/1994 | Aldissi | 174/36 |
| 5,329,064 | 7/1994 | Tash et al. | 174/36 |

FOREIGN PATENT DOCUMENTS

| | | |
|---|---|---|
| 3-182009 | 8/1991 | Japan . |

*Primary Examiner*—Dean A. Reichard
*Attorney, Agent, or Firm*—Lawrence D. Cutter

[57] ABSTRACT

A high-speed cable includes first and second coaxial conductor sets which are disposed in mirror image fashion within a carbon-impregnated polymer jacket. Each coaxial conductor set includes a wire core surrounded by a dielectric layer and a ground conductor disposed along side the dielectric layer. The wire core, the dielectric layer and the ground conductor are themselves surrounded by a conductive shield layer. In addition to assisting in bleeding off accumulated electric charge, the polymer jacket also preserves conductor set alignment and planarity especially following handling, cutting, trimming and stripping operations. The cable is excellent for high-speed applications, is easily routed and preserves its electrical properties under various field conditions.

6 Claims, 1 Drawing Sheet

HIGH-SPEED CABLE

BACKGROUND OF THE INVENTION

The present invention is generally directed to the construction of high-speed coaxial cables. More particularly, the present invention is directed to the structure and construction of individual cables having a pair of signal wires and is particularly directed to such cables which exhibit uniform and controllable resistance under a variety of field conditions. Even more particularly, the present invention is directed to a high-speed cable which is capable of operation at speeds in access of 25 MHz and which can be used in connection with pluggable connectors for insertion into circuit board connection sockets. The present invention is also directed to the construction of high-speed cables which may be employed in conjunction with cable connectors exhibiting densely packed linear spacing of less than 0.025 inches. Additionally, it is noted that the present invention is directed to the construction of a high-speed cable which is usable in a high-speed emulation engine and, in particular, which is usable for direct connections to and from printed circuit board connector sockets which are disposed around chips on a printed circuit board.

The construction of high-speed cables is difficult because the speed, tolerance and variability requirements are strict and severe. For example, a ribbon cable such as that shown in U.S. Pat. No. 5,256,082, issued to Yaegashi et al., is completely inappropriate for the high-speed cabling applications required by the present day emulation engines. In particular, it is noted that a ribbon cable is very difficult to route. It cannot be bent in sideways directions easily, and if indeed it is bent, there is a degradation in the uniformity of its electrical characteristics, particularly its electrical resistance. However, for purposes of the present invention, it is important that the electrical characteristics of the cabling be precisely controllable and consistent from one cable unit to the next and also that the characteristics be relatively constant over time particularly when the cabling is possibly subjected to handling and movement, even the kind that occurs during installation and set-up of a new machine in which the cable is deployed.

For example, FIG. 1 in the patent to Yaegashi et al. shows coaxial conductors embedded in an insulative material. However, in spite of the fact that the drawing therein illustrates a somewhat substantially constant-looking spacing for the conductors, in practice, such ribbon cables are difficult to manufacture with the stable electrical characteristics which are required for high-speed operation. In particular, the amount of insulative material which may be present between the various coaxial conductors is highly variable. For example, in the present invention, the applicant sought to create a cable with a variation in impedance of less than 10 percent in a 50 ohm cable. Not only is the impedance value difficult to produce consistently in a ribbon cable, but bending and routing of ribbon cables will distort the alignment of the conductors and will produce undesirable and unpredictable changes in the impedance value.

Another significant disadvantage of ribbon cabling for high-speed use is the variability that is introduced into the electrical properties of the cable when it is cut and/or when it is trimmed for purposes of exposing conductors for attachment to the other components in a high-speed connector or circuit. Furthermore, cutting of a ribbon cable such as is described by Yaegashi et al. introduces even further distortions and variations in the insulative material which is disposed between the different coaxial conductors in the ribbon. Furthermore, the ribbon cable arrangement shown in FIG. 1 of the patent to Yaegashi et al. does not provide good protection against nicking of the central signal conductor during cutting and stripping operations. This is particularly true at the left end of the ribbon cable shown therein. Thus, while it is desirable not to nick any of the conductors during cutting operations, it is seen that ribbon cable is, in fact, particularly sensitive to this kind of damage during cutting and stripping operations which are necessary to both cut the cable to its desired length and also to strip off material to expose the inner conductors.

Furthermore, it is noted that the alignment of the coaxial conductors in the patent to Yaegashi et al. will, in fact, be somewhat haphazard even as the ribbon cable comes from a manufacturer. This non-alignment situation is only aggravated when the cable is cut, stripped or bent. In particular, the planarity of the alignment suggested in their figure is, in fact, not preserved during ribbon cable cutting and trimming operations. In short, ribbon cable is impractical for use as a high-speed cable in emulator or mainframe computer systems. While ribbon cable is an appropriate conductive link in relatively low-speed personal computer applications, for truly high-speed applications, ribbon cable is an inappropriate and inadequate choice of conductor.

SUMMARY OF THE INVENTION

In accordance with a preferred embodiment of the present invention, a high-speed cable comprises a first coaxial conductor set and a second coaxial conductor set both of which are disposed within a polymer jacket which is impregnated with a conductive material. Each coaxial conductor set includes a copper wire core, a dielectric layer surrounding the copper wire core, a ground conductor exterior to the dielectric layer and running along side of it and a conductive shield layer surrounding both the dielectric layer and the ground conductor with which it is in contact. The second coaxial conductor set is disposed in mirror image symmetry with respect to the first coaxial conductor set. Furthermore, the outer conductive shield layers for each of the two coaxial conductor sets are in electrical contact with one another. This eliminates problems of variable impedance which might otherwise result from different amounts of insulative material being disposed between the coaxial conductor sets. In the present invention, there is no bulk material (either conductive or insulative) disposed between the pairs of coaxial conductor sets. In the present invention, a partially conductive jacket surrounds both the first and second conductor sets and provides a mechanism for bleeding off and/or reduction of tribo-electric charge which may otherwise accumulate on the cable. Such charge accumulation is an extremely undesirable feature. Furthermore, it is noted that the mirror image symmetry of the present invention provides protection for the central, signal bearing conductors against nicking which could otherwise occur during cutting or stripping operations.

Accordingly, it is an object of the present invention to provide high-speed cable which is capable of easily being handled and routed.

It is also another object of the present invention to provide cable which is capable of being used in conjunction with connectors for attachment to corresponding sockets on printed circuit boards.

It is yet another object of the present invention to provide high-speed cable which is capable of being handled, cut, trimmed and stripped without significantly impacting its electrical characteristics.

It is a still further object of the present invention to provide a high-speed cable which is capable of connection to printed circuit board land patterns which are spaced together in a linearly dense configuration.

It is still another object of the present invention to provide a cable in which the impedance is 50 ohms.

It is a still further object of the present invention to provide a high-speed cable for use in mainframe and hardware emulation systems.

It is a still further object of the present invention to provide a high-speed cable in which the planarity of its conductive components is preserved even after cutting, trimming, and stripping operations.

Lastly, but not limited hereto, it is an object of the present invention to provide a single individual high-speed cable capable of carrying two signal conductors.

DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION OF THE INVENTION

Figure 1:
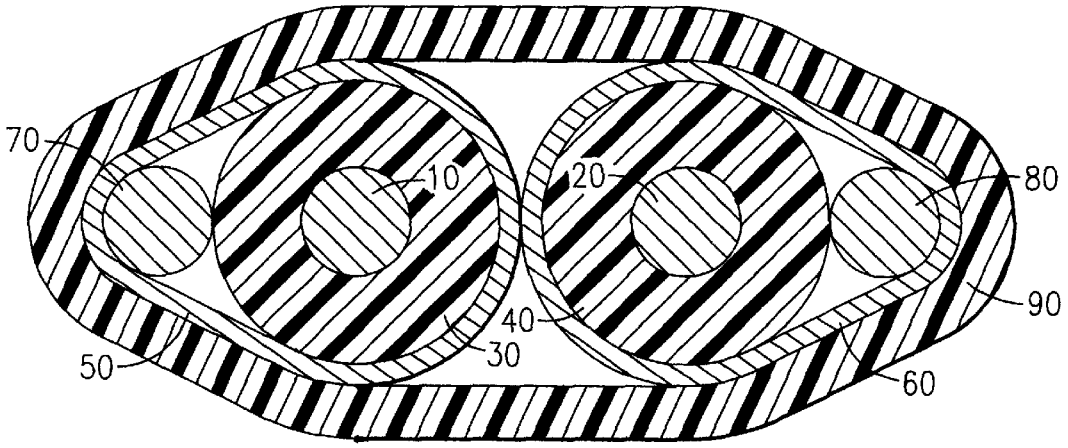
FIG. 1 is a cross-sectional side-elevation view of a high-speed cable manufactured in accordance with the present invention.

In accordance with a preferred embodiment of the present invention, a high-speed cable comprises two coaxial conductor sets. A first coaxial conductor set is shown and includes first copper wire core 10 which is surrounded by first dielectric layer 30. First ground conductor 70 is disposed exterior to and adjacent to first dielectric layer 30. First conductive shield layer 50 is also provided so as to surround ground conductor 70 and dielectric material 30. The dielectric material preferably comprises a material such as polytetrafluroethylene (PTFE). Shield layer 50 is, in fact, in contact with dielectric material 30 and ground conductor 70.

In addition to the first coaxial conductor set which comprises copper wire core 10, dielectric layer 30, ground conductor 70 and conductive shield layer 50, there is also present a second coaxial conductor set which is similar in construction to the first set and which comprises copper wire core 20, dielectric layer 40, ground conductor 80 and conductive shield layer 60.

The first and second coaxial conductor sets are disposed adjacent to one another and in mirror image configuration as shown in the Figure. In particular, first and second conductive shield layers 50 and 60 respectively are disposed in electrical contact with each other. Likewise, conductive shield layers 50 and 60 are also in electrical contact with ground conductors 70 and 80 respectively. It is additionally noted that conductive wire cores 10 and 20 along with ground conductors 70 and 80 lie substantially in the same plane with ground conductors 70 and 80 being disposed along the exterior portion of the cable. Additionally, it is noted that the first and second conductor sets are disposed within a polymeric jacket which is preferably impregnated with a conductive material such as carbon. This jacket surrounds both the first and second conductor sets and is in physical contact with first and second conductive shield layers 50 and 60 respectively. The presence of polymeric impregnated jacket 90 provides a mechanism for discharging any static charge which may otherwise tend to accumulate on the cable. Additionally, it is noted that the shape and elastomeric nature of jacket 90 provides a stable mechanism for preserving the alignment of the two coaxial conductor sets. This alignment, and its stability, is important for maintaining the cable properties within an acceptable range.

Figure 2:
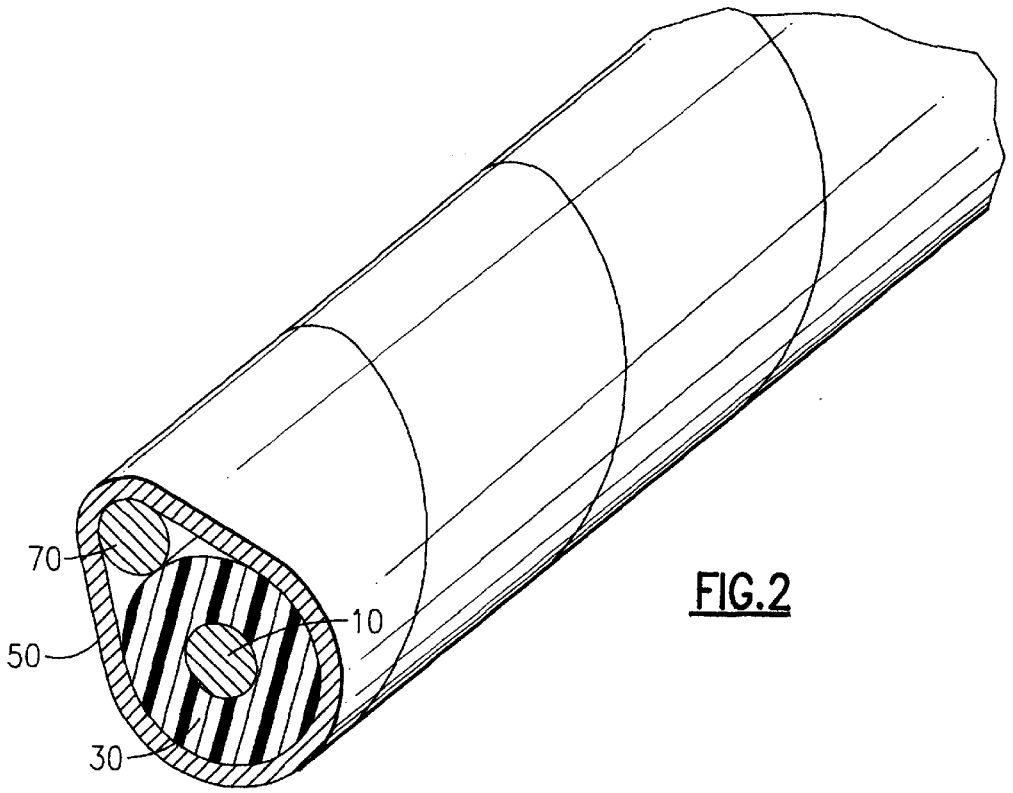
FIG. 2 illustrates spiral wrapped conductive material.

In preferred embodiments of the present invention, wire cores 10 and 20 preferably comprise a material such as solid copper. Additionally, conductive shield layers 50 and 60 preferably comprise a material such as aluminum disposed in a foil and preferably also disposed in a spiral wrap fashion along the length of the cable (see FIG. 2);

From the above, it should be appreciated that the cable shown in the Figure satisfies the objectives set forth above. In particular, it is seen that the cable herein includes two coaxial conductor sets which do not have disposed between them bulk material which is capable of exhibiting extraneous, uneven, unpredictable and unstable electrical characteristics. It should further be appreciated that the cable of the present invention, having only two signal conductors, is readily capable of being routed around bends and likewise, primarily because of the presence of elastomeric jacket 90, is capable of being handled, cut, trimmed and stripped without impairing its electrical characteristics.

While the invention has been described in detail herein in accordance with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A high-speed cable comprising:

a first coaxial conductor set which includes:
- a first conductive wire core;
- a first dielectric layer surrounding said first wire core;
- a first ground conductor exterior to and adjacent to said first dielectric layer;
- a first conductive shield layer surrounding said first dielectric layer and also surrounding and in contact with said first ground conductor;

a second coaxial conductor set which includes:
- a second conductive wire core;
- a second dielectric layer surrounding said second wire core;
- a second ground conductor exterior to and adjacent to said second dielectric layer;
- a second conductive shield layer surrounding said second dielectric layer and also surrounding and in contact with said second ground conductor;
- said first and second coaxial conductor sets being disposed adjacent to one another with said first and second conductive shield layers being in electrical contact with each other, and with said first ground conductor, said first wire core, said second wire core and said second ground conductor lying substantially in the same plane, and with said first and second ground conductors being disposed in opposed positions with respect to said cores; and
- a polymer jacket impregnated with conductive material and surrounding said first and second coaxial conductor sets and in contact with said first and second conductive shield layers.

2. The cable of claim 1 in which said first and second conductive wire cores comprise solid copper.

3. The cable of claim 1 in which at least one of said first and second dielectric layers comprise polytetrafluroethylene.

4. The cable of claim 1 in which at least one of said first and second conductive shield layers comprises aluminum.

5. The cable of claim 1 in which said first and second conductive shield layers are disposed in a spiral fashion.

6. The cable of claim 1 in which said conductive material impregnating said polymer jacket comprises carbon particles.

* * * * *